US011602195B2

(12) United States Patent
Bosmans et al.

(10) Patent No.: US 11,602,195 B2
(45) **Date of Patent: *Mar. 14, 2023**

(54) FLEXIBLE VENTILATED INSOLES

(71) Applicant: RSPRINT N.V., Leuven (BE)

(72) Inventors: Lode Bosmans, Leuven (BE); Kateryna Nikonenko, Leuven (BE); Artur Alieksieienko, Leuven (BE)

(73) Assignee: RS PRINT N.V., Beringen (BE)

( * ) Notice: Subject to any disclaimer, the term of this patent is extended or adjusted under 35 U.S.C. 154(b) by 187 days.

This patent is subject to a terminal disclaimer.

(21) Appl. No.: 16/624,875

(22) PCT Filed: Jun. 29, 2018

(86) PCT No.: PCT/EP2018/067642

§ 371 (c)(1),
(2) Date: Dec. 19, 2019

(87) PCT Pub. No.: WO2019/002575

PCT Pub. Date: Jan. 3, 2019

(65) Prior Publication Data

US 2020/0128914 A1 Apr. 30, 2020

Related U.S. Application Data

(60) Provisional application No. 62/527,311, filed on Jun. 30, 2017.

(51) Int. Cl.
*A43B 17/08* (2006.01)
*A43B 7/1445* (2022.01)

(52) U.S. Cl.
CPC ..... *A43B 17/08* (2013.01); *A43B 7/1445* (2013.01)

(58) Field of Classification Search
CPC ..... A43B 17/08; A43B 7/1485
See application file for complete search history.

(56) References Cited

U.S. PATENT DOCUMENTS 2,887,793 A * 5/1959 Starr ..... A43B 7/06 36/3 R
4,619,055 A * 10/1986 Davidson ..... A43B 7/146 36/28
4,910,882 A * 3/1990 Goller ..... A43B 17/08 36/3 B
5,675,914 A * 10/1997 Cintron ..... A43B 17/08 36/29
5,799,413 A * 9/1998 Argyris ..... A43B 7/00 36/141
5,845,418 A * 12/1998 Chi ..... A43B 17/03 36/3 B (Continued)

FOREIGN PATENT DOCUMENTS

CH 241204 A * 2/1946 ..... A43B 17/08
DE 1010418 B * 6/1957 ..... A43B 17/08

(Continued)

*Primary Examiner* — Megan E Lynch
(74) *Attorney, Agent, or Firm* — Dinsmore & Shohl LLP

(57) ABSTRACT

Designs for insoles comprising forefoot support are described herein. In certain embodiments, the forefoot support comprises openings and grooves that confer ventilation and flexibility. Insoles may be customized for individual users and specific types of footwear.

13 Claims, 7 Drawing Sheets

(56) References Cited

U.S. PATENT DOCUMENTS

| | | | | |
|---|---|---|---|---|
| 2008/0110063 | A1* | 5/2008 | Liu | A43B 3/108 36/3 B |
| 2008/0110064 | A1* | 5/2008 | Liu | A43B 17/08 36/3 B |
| 2008/0216359 | A1* | 9/2008 | Cohen | A43B 17/08 36/3 B |
| 2008/0295358 | A1* | 12/2008 | Lin | A43B 17/08 36/43 |
| 2008/0307679 | A1* | 12/2008 | Chiang | A43B 1/0009 36/3 B |
| 2009/0119953 | A1* | 5/2009 | Lin | A43B 17/08 36/3 B |
| 2012/0192452 | A1* | 8/2012 | Lewis | A43B 13/38 36/44 |
| 2012/0266494 | A1* | 10/2012 | Ko | A43B 7/125 36/84 |
| 2014/0013631 | A1* | 1/2014 | Kim | A43B 17/14 36/25 R |
| 2014/0366399 | A1* | 12/2014 | Wakeland | A43B 13/386 36/44 |
| 2016/0345667 | A1* | 12/2016 | Kohatsu | A43D 1/025 |
| 2018/0192739 | A1* | 7/2018 | Granger | A43B 7/1435 |

FOREIGN PATENT DOCUMENTS

| | | | | | |
|---|---|---|---|---|---|
| FR | 333621 | A | * | 11/1903 | A43B 17/08 |
| FR | 1155234 | A | | 4/1958 | |
| FR | 1511344 | A | * | 1/1968 | A43B 17/08 |
| WO | 0021398 | A1 | | 4/2000 | |
| WO | 2011108011 | A1 | | 9/2011 | |
| WO | 2015169942 | A1 | | 11/2015 | |

* cited by examiner

FLEXIBLE VENTILATED INSOLES

CROSS-REFERENCE TO RELATED APPLICATIONS

This application claims priority to U.S. Provisional Patent No. 62/527,311 filed on 30 Jun. 2017. The content of the provisional application is hereby incorporated by reference in its entirety.

BACKGROUND

Technical Field

The field of the present disclosure is insoles for footwear, where the insoles comprise a flexible, ventilated forefoot support. According to embodiments herein, such insoles may comprise openings and structural features that confer specific properties.

Description of the Related Technology

Footwear and component parts of footwear may be configured to serve diverse functions ranging from protection and support of a user's foot to correction of a user's gait and posture to providing comfort to the user. Inner footwear components such as insoles, which directly contact the sole of user's foot, mediate many of these functions. Current insole technologies are quickly evolving, and new insole designs incorporate new materials and new structural features, as well as custom features for specific users. Nonetheless, a few core traits such as flexibility and durability remain common to all insoles. Flexbility in the insole ensures that the insole bends with the movement of the user's foot, for example, to permit the user's toes to bend to a full degree of flexion during the gait cycle. Durability of the insole ensures that the insole will continue to perform its functions over time without breaking or losing its shape. In addition, ventilation is an important trait in insoles, especially for insoles that will be worn over long periods and/or used intensively.

In general, adequate ventilation contributes to comfort, performance, and long-term usability of footwear. Footwear used for sports, in particular, may have unique requirements for ventilation due to the specialized shape and function of footwear designed for specific sports. In some footwear designs, ventilation comes from air holes and/or breathable regions built in the upper of the shoes, such as mesh fabric in the toe area of running shoes. Other footwear designs incorporate ventilation elements in the sole of the footwear. In cycling shoes, indentations that traverse diagonally in the sole of the shoes may be used to optimize aerodynamics in addition to allowing air flow for ventilation. Still other designs feature inlet and outlet channels through which air is pushed when the user takes a step.

Many of these current solutions for ventilation are incorporated into the footwear design, which limits the versatility of these solutions for different types of footwear. One approach is to use removable insoles, where the insoles serve other functions like providing support, cushioning, or shock absorption, and additionally have vents that promote air circulation. However, when vents are added to insoles designed for other purposes, the ventilation is a secondary consideration and may not be optimal. Moreover, the position of the vents will not be suited for all designs, types, or brands of footwear. In cycling shoes, for example, the vents in the insole should ideally match the position of any vents built into the cycling shoes, but each manufacturer has their own unique shoe designs with specific vents. Finally, many of the current insoles are stiff and thick, which may impair the user's movement in some directions, and further limit the types of shoes for which the insoles are suitable.

There remains a need in the art for insoles that are ventilated and flexible. The insoles should be adaptable to a variety of types of footwear and should leave options for incorporating other functions in addition to ventilation. Moreover, it should be possible to customize insoles for individual users and/or specific footwear.

SUMMARY

One aspect of the present disclosure relates to a forefoot support of a footwear insole, comprising: a plurality of openings; a rim configured to form a border around at least a portion of the forefoot support; a first groove traversing the forefoot support along a first axis, wherein the first groove is configured to provide flexibility to the forefoot support in a first direction; and a second groove traversing the forefoot support along a second axis, wherein the second groove is configured to provide flexibility to the forefoot support in a second direction.

In some embodiments, the footwear insole further comprises at least one of a midfoot support and a hindfoot support. The footwear insole may be a one-piece structure.

In certain embodiments, the plurality of openings are arrayed in one line or in multiple lines. The multiple lines may be arrayed in rows. The plurality of openings may be regularly spaced apart, and the plurality of openings in each row is staggered with respect to the plurality of openings in the row above.

The one line or multiple lines may be located in the first groove traversing the forefoot support, the second groove traversing the forefoot support, or both the first groove and the second groove.

In certain embodiments, the first groove and the second groove are located in a bottom surface of the forefoot support. The bottom surface of the forefoot support may be configured to contact a surface on a footwear article and not contact a surface of a user's foot.

The first groove and the second groove may intersect to form recessed structures that are separated by raised structures. The first groove and the second groove may be configured to provide greater flexibility when the raised structures are bent towards one another than when the raised structures are bent away from one another. The raised structures may be rectangular in shape.

In some embodiments, the first groove partially traverses the forefoot support. The first groove may traverse an entire line between two points on the rim of the forefoot support.

In certain embodiments, the first axis is an anterior-posterior axis and the second axis is a medial-lateral axis. The forefoot support may further comprise a plurality of grooves that are substantially parallel to the first groove, and/or a plurality of grooves that are substantially parallel to the second groove. The plurality of grooves in the first direction, in the second direction, or in both directions may correspond to locations of the plurality of openings.

The rim of the forefoot support may comprise one or more notches. The notches may be positioned to correspond to joints in a user's forefoot.

In some embodiments, the forefoot support is custom designed to be specific to a particular foot. The forefoot support may be manufactured using additive manufacturing techniques. The forefoot support may comprise a soft top layer.

A further aspect of the present disclosure relates to a footwear article, comprising: an outsole; and an insole comprising a forefoot support comprising: a plurality of openings; a rim configured to form a border around at least a portion of the forefoot support; a first groove traversing the forefoot support along a first axis, the first groove being located on a bottom surface of the forefoot support, wherein the first groove is configured to provide flexibility to the forefoot support in a first direction; and a second groove traversing the forefoot support along a second axis, the second groove being located on the bottom surface of the forefoot support, wherein the second groove is configured to provide flexibility to the forefoot support in a second direction, wherein the bottom surface of the forefoot support is configured to face toward the outsole.

BRIEF DESCRIPTION OF THE DRAWINGS

FIG. 5A is a perspective view of the top surface of an example insole, showing the anterior-posterior (AP) and medial-lateral (ML) axes, around each of which the insole bends. FIG. 5B shows the top surface of the example insole. FIG. 5C shows the bottom surface of the example insole.

DETAILED DESCRIPTION OF CERTAIN INVENTIVE EMBODIMENTS

Described herein are example embodiments of footwear insoles (also "insoles" or "inner footwear components") which are flexible, durable, versatile, and provide ventilation. In general, the insole may be an inner portion of footwear that contacts (e.g., directly) the bottom (and to some extent the side(s)) of a user's foot. Insoles may support at least one of the forefoot, midfoot, and hindfoot of the user. Insoles may be fixed (i.e., permanent) in the footwear, or may be removable so that the insoles can be used in different articles of footwear. For example, insoles may be designed to fit inside of ready-to-use footwear. Insoles may be configured to fit inside of footwear before the final footwear product is fully manufactured or ready to use, and may either be permanently affixed to the final footwear product, or may be removable. Insoles may be a standard design and/or insoles may be customized for a specific user. Footwear may be a shoe, boot, sandal, skate, slipper, or any combination of these, and may be specialized for a sport such as running, skiing, cycling, walking, climbing, or more.

Insole Design

One aspect of the present disclosure relates to a forefoot support of a footwear insole, comprising a plurality of openings; a rim configured to form a border around at least a portion of the forefoot support; a first groove traversing the forefoot support along a first axis, wherein the first groove is configured to provide flexibility to the forefoot support in a first direction; and a second groove traversing the forefoot support along a second axis, wherein the second groove is configured to provide flexibility to the forefoot support in a second direction.

In some embodiments, the footwear insole further comprises at least one of a midfoot support and a hindfoot support. The insole may be a one-piece structure, for example, where a forefoot support is attached to a first end of a midfoot support and a hindfoot support is attached to a second end of a midfoot support. The insole may comprise a base layer, which comprises one or more of a variable thickness layer, a directional stiffness layer, a stability layer, and a reinforcement layer. The insole may comprise corrective features specifically designed to affect the fit and/or behavior of the insole when worn and used by a user. In the insole, the forefoot support may comprise structures that are distinct from structures in the midfoot support and/or hindfoot support. For example, the midfoot support and the hindfoot support may comprise a base layer (comprising at least one of a variable thickness layer, a directional stiffness layer, a stability layer, and a reinforcement layer), while the forefoot support comprises a plurality of openings, a rim, a first groove and a second groove. In some embodiments, the forefoot support further comprises at least one notch in the rim.

Figure 5A:
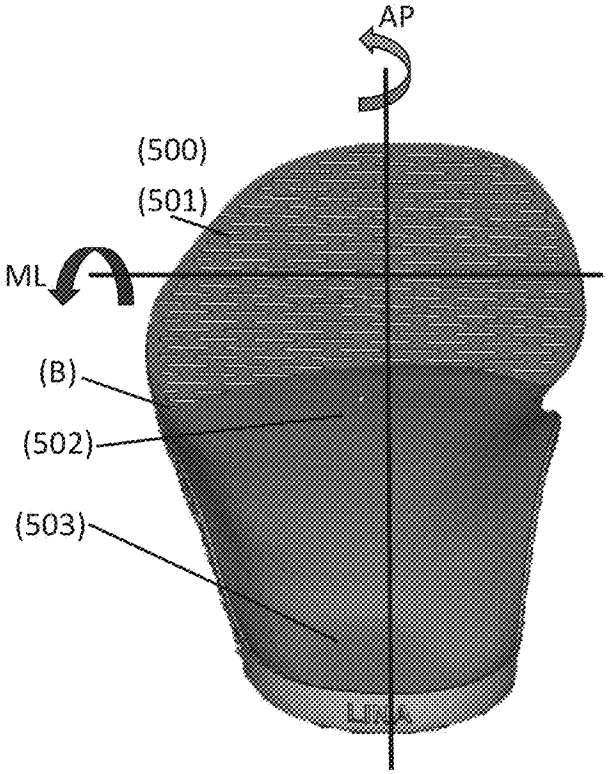
FIGS. 5A-5C shows an example structure of insoles according to embodiments disclosed herein.
Figure 5B:
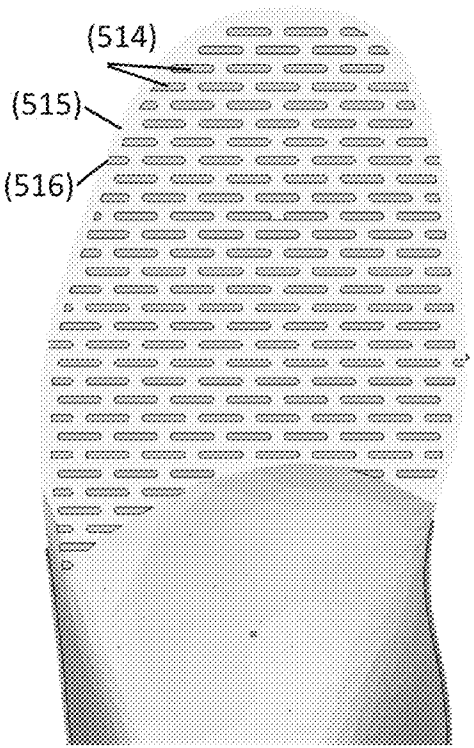
Figure 5C:
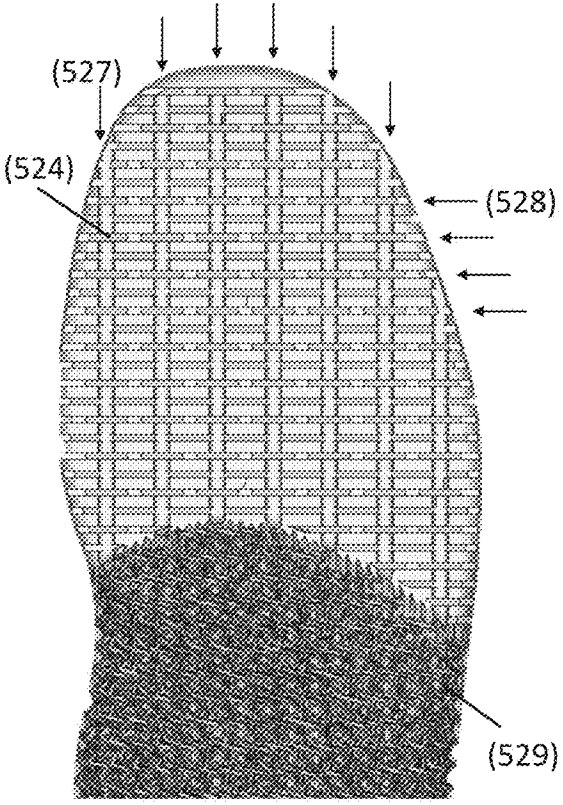

FIGS. 5A-5C show an example of a forefoot support. FIG. 5A is a perspective view of the top surface of the insole, which is configured to contact the sole of a user's foot. In FIG. 5A, the insole (500) is a one-piece structure comprising a forefoot support (501) that is connected to a midfoot support (502) and a hindfoot support (503). The border between the forefoot support (502) and midfoot support (503) is indicated by the letter "B," and the different structures of the forefoot support and the midfoot support are apparent on each side of the border. A border between the midfoot and hindfoot support is not indicated, as the structures of these regions may be similar. FIG. 5B shows the top view of the forefoot support, at the top surface which is configured to contact the user's forefoot. The forefoot support comprises a plurality of openings (514), a rim (515), and a notch in the rim (516). FIG. 5C is a view of the bottom of the insole, which is configured to contact the footwear (e.g., a midsole or an outsole of the footwear). In this view, a first groove in one direction (527) is repeated (vertical arrows indicate most but not all grooves in this direction) and a second groove in a second direction (528) is repeated (horizontal arrows indicate most but not all grooves in this direction). Example structures in the bottom surface of the midfoot support are visible (529). An opening (524) is shown. The combination of structural features in this forefoot support confer flexibility around the anterior-posterior (AP) axis and the medial-lateral (ML) axis, as indicated by the arrows in FIG. 5A.

For flexibility, openings may be configured to enable bending of the insole in one or more directions. Insoles may be made of a material that is resilient, in order to provide support for the user's foot, but resilient materials such as firm plastics or polyamides may be too stiff to bend or twist when the foot is moving. Openings may be configured to confer flexibility in stiff materials that do not otherwise bend.

For ventilation, moisture and heat from inside the footwear and air from outside the footwear should be able to circulate. In the forefoot support described herein, the plurality of openings allows air to flow around the forefoot structure, while heat and moisture from the user's foot can escape. In some embodiments, the plurality of openings are arrayed in a line, which may be straight, curved, or a combination of both. The line may follow a contour of the user's anatomy, or may be placed in a region that will support the forces applied when the user's foot is in motion. The line may also correspond to an area of the user's foot with high levels of heat and/or moisture. In some embodiments, the plurality of openings is arrayed in one line, or in multiple lines. The multiple lines may be arrayed in rows, as in FIGS. 5A-5C. The rows may be evenly spaced apart.

Each of the plurality of openings may have different shapes, or all of the openings may have the same shape. For example, the openings may be rectangles, or portions of rectangles (see (514) in FIG. 5B and (524) in FIG. 5C). In some embodiments, each of the openings in the plurality are rectangular, and are arrayed in repeating rows. The rows of rectangular openings may span the entire surface of the forefoot support, as in FIGS. 5A and 5B. The plurality of openings may be regularly spaced apart. The plurality of openings may be staggered, so that each row of openings is offset relative to the row of openings above and below it. The rectangles may be truncated at the edges of the forefoot support.

Openings may be arrayed in a pattern or may be randomly arrayed. In some embodiments, openings may be spaces in between beams in a lattice structure. For example, a lattice may be a woven lattice, or may comprise an array of unit cells wherein each unit cell comprises at least one wall and one opening. Openings may also be placed in a direction corresponding to the direction that a user's foot will move, so that the opening is configured to provide flexibility to the insole in the direction of movement.

Figure 6A:
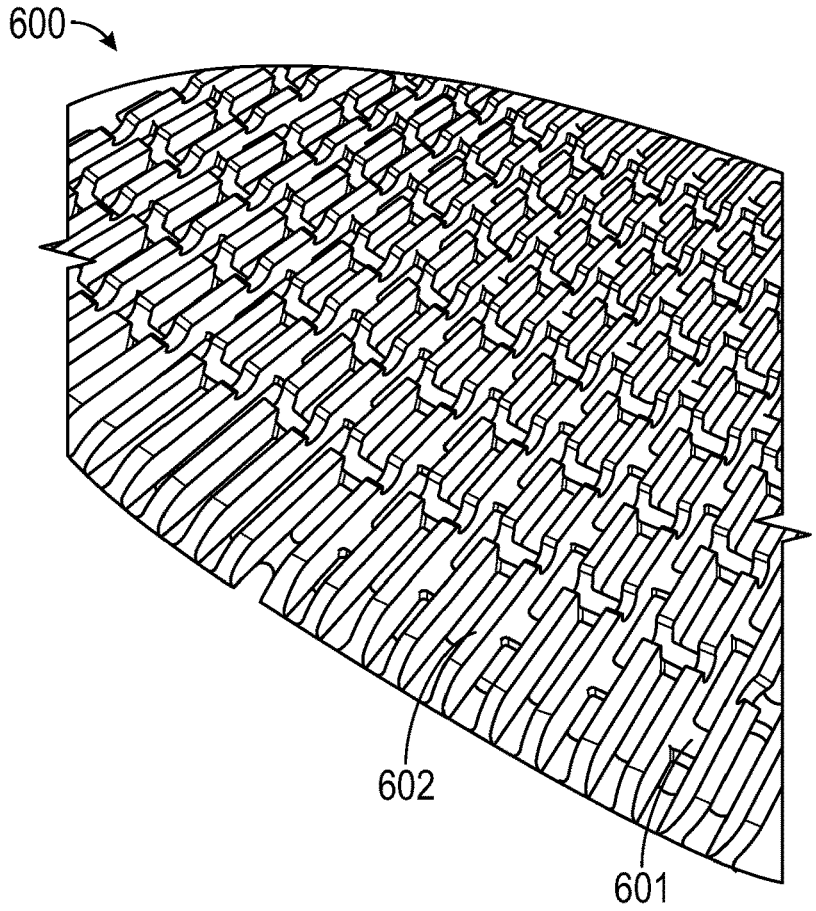
FIGS. 6A and 6B show a close-up view of the structures visible from the bottom surface of an example insole.
Figure 6B:
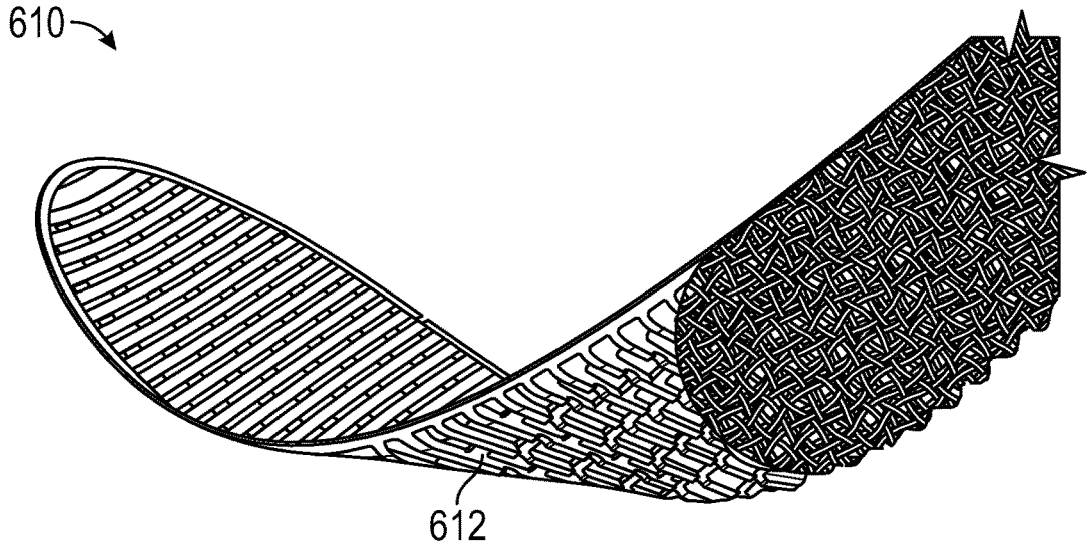

The grooves in the forefoot support confer flexibility, and may be configured to provide flexibility in a desired direction (or directions), and to a greater or lesser extent, depending on the user's needs. As shown in FIG. 5C, a first groove (527) and a second groove (528) may be located in the bottom surface of the forefoot support. The bottom surface of the forefoot support may be configured to contact a surface on a footwear article and not contact the sole of a user's foot. The first groove and/or the second groove may be repeated to create a plurality of first grooves and/or a plurality of second grooves. The location of the openings may be either completely or partially in a groove. For example, in FIG. 5C, opening (524) lies completely in a horizontal groove (528), and partially in a vertical groove (527). In certain embodiments, the openings, whether arrayed in one line or multiple lines, are located in the first groove traversing the forefoot support, the second groove traversing the forefoot support, or both the first groove and the second groove.

Where the first groove and the second groove intersect, recessed structures may be formed. These recessed structures may be separated by raised structures. The first groove and the second groove may be configured to provide greater flexibility when the raised structures are bent away from one another than when the raised structures are bent towards one another. FIG. 6A-6B show a view of the bottom surface of a forefoot support (600). FIG. 6A shows the recessed structures (601) and raised structures (602) that are generated by the intersecting grooves. FIG. 6B shows the flexibility of the forefoot support (610) when the raised structures such as (612) are bent away from one another. This directional flexibility is configured to allow the forefoot support to bend with the user's foot. The shape of the raised and recessed structures may vary, depending on the shape of the first groove and the second groove. In some embodiments, the first groove and the second groove are polygonal, for example, rectangular. The raised structures created by these example rectangular grooves are also rectangular in shape.

The dimensions of the first groove and the second groove may correspond to the dimensions of the forefoot support, or may correspond to regions of a user's foot. For example, a first groove that traverses the length of the forefoot support may traverse the entire length of the forefoot support (i.e., from a point on the rim at the distal end of the insole to a point at the border where the forefoot support meets the midfoot support), or may partially traverse the length of the forefoot support. Similarly, a second groove that traverses the width of the forefoot support may traverse the entire width of the forefoot support (i.e., from one point on the rim of the inner side of the forefoot support to another point on the rim of the outer side of the forefoot support), or may partially traverse the width of the forefoot support. In certain embodiments, a first groove traverses an entire line between two points on the rim of the forefoot support.

Flexibility of the forefoot support results from the bending of the first groove and the second groove. Accordingly, the grooves may be configured in any direction in which flexibility of the forefoot support is desired. Flexibility may be desired to permit movements of the metatarsophalangeal (MTP) joints in the forefoot, such as flexion, extension, abduction, adduction and circumduction. The forefoot support may bend in the same direction as the user's foot during walking or running. The forefoot support may bend in a direction that facilitates the insertion or removal of the insole into the article of footwear. In some embodiments, the forefoot support will be flexible in a direction around a medial-lateral axis, flexible in a direction around an anterior-posterior axis, or flexible in both directions.

The first groove may traverse the forefoot support along an anterior-posterior axis. The second groove may traverse the forefoot support along a medial-lateral axis. The first groove and/or the second groove may traverse the forefoot support along an angle relative to either the anterior-posterior axis or to the medial-lateral axis. A plurality of grooves may be substantially parallel to the first groove and/or a plurality of grooves may be substantially parallel to the second groove. Within each one of the grooves in the plurality of grooves in the first direction, in the second direction, or in both directions, there may be the plurality of openings. Thus, any given opening may be arrayed in the grooves, either partially or completely. In FIG. 5C, opening (524) lies completely in groove (528), while a portion of opening (524) lies in groove (527).

The first groove and the second groove may be arranged at an angle relative to each other. Grooves may be present on the top surface of the forefoot support and/or on the bottom surface of the forefoot support. In some embodiments, at least a first groove traverses the top surface of the forefoot support and at least a second groove traverses the bottom surface of the forefoot support.

The rim of the forefoot support may provide stability and strength. In the absence of a rim, the edge of the forefoot support would have a groove, a raised structure, a recessed structure, or a portion of any of these. The variation in structures at the edge of the forefoot support would create a rough finish, and any protruding portions of a structure could be caught in the footwear during insertion or removal of the insole, or during use of the insole. The rough finish could also cause discomfort to the user, for example, if protruding portions become lodged in the user's foot or socks. The rough finish would also be vulnerable to tearing if stress is placed on an area where structures are exposed, particularly the recessed structures which are thin. In some embodiments, the rim spans the entire edge of the forefoot support. Alternatively, the rim may span only a portion of the edge of the forefoot support, for example, only the medial (inner) edge or the lateral (outer) edge.

Figure 7A:
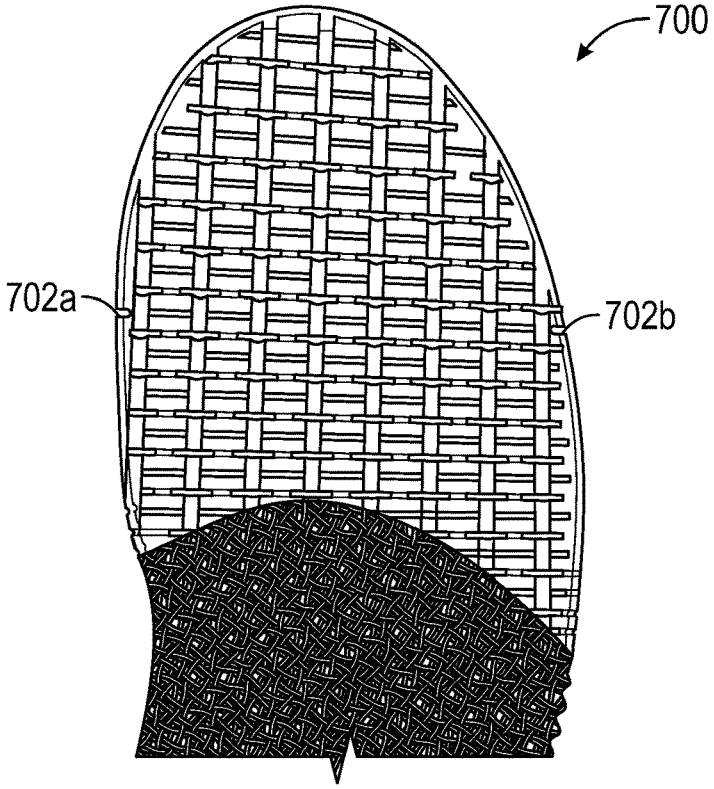
FIG. 7A shows an example full-forefoot insole.
Figure 7B:
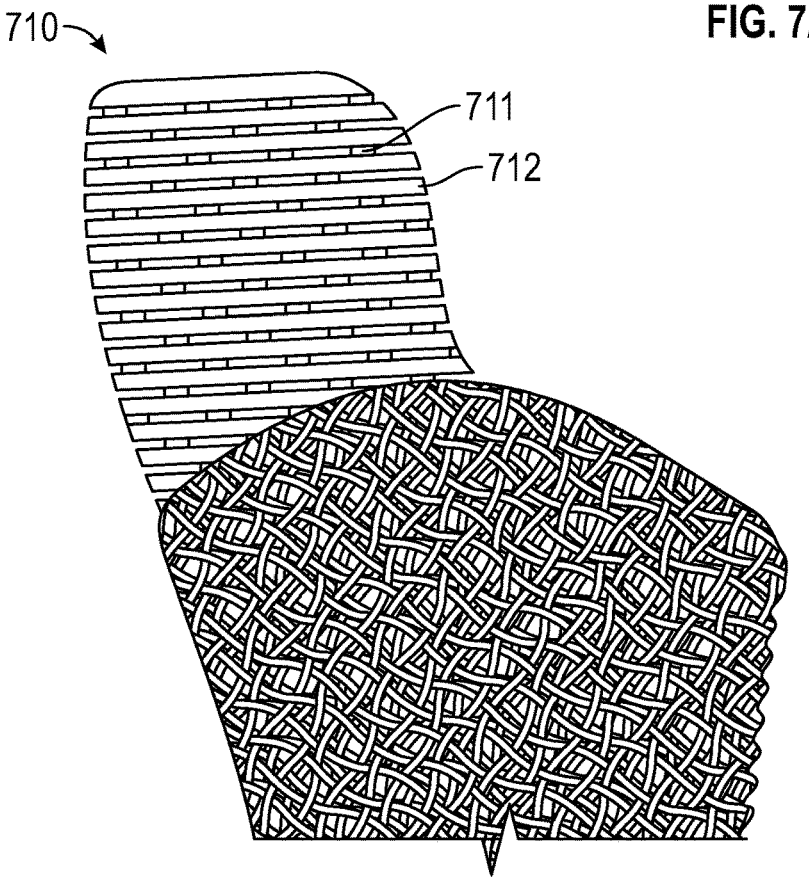
FIG. 7B shows an example partial forefoot insole.

In some embodiments, the edge of the forefoot support may have a dangling structure or a dangling end, for example, where a portion of an opening is cut off at the border of the forefoot support (see dangling ends (711 and 712) in FIG. 7B). The rim around the forefoot structure may comprise a loop or a beam that connects two or more dangling ends. In some embodiments, the rim comprises a series of beams that connect each dangling end to at least one other dangling end.

A rim may be broader in some regions of the forefoot support than others, for example, to cover more of the surface area of the forefoot support or may be thicker in some regions than in others. In some embodiments, a portion of the rim may comprise structures such as undercuts or perforations.

In certain embodiments, the rim comprises one or more notches. FIG. 7A shows the bottom surface of an example forefoot support 700, wherein the rim comprises two notches (702*a* and 702*b*). A notch may be positioned to correspond to joints in a user's forefoot, for example, at the location on the rim of the forefoot support that corresponds to a user's metatarsophalangeal (MTP) joints.

The forefoot support may be large enough to support the entire forefoot of the user, including all the phalanges. The forefoot support may be sized to support the entire forefoot, plus some additional area in order to fill as completely as possible the shoe in which it will be placed. In certain embodiments, the forefoot support is smaller than the forefoot of the user, and provides support only to a region of the forefoot. FIG. 7B shows the bottom surface of an example forefoot support 710 that supports only the medial (inner) side of the user's forefoot. As the forefoot support may be configured to align the user's foot, knee and/or hip, either all or a portion of the user's forefoot may be supported.

The forefoot support may further comprise a soft top layer. In some embodiments, the insole design and composition may comprise a soft top layer (e.g., foam, rubber, etc.) affixed (e.g., using adhesive, glue, hook-and-loop fasteners, etc.) on top of the forefoot support.

A further aspect of the present disclosure relates to a footwear article, comprising an outsole; and an insole comprising a forefoot support comprising: a plurality of openings; a rim configured to form a border around at least a portion of the forefoot support; a first groove traversing the forefoot support along a first axis, the first groove being located on a bottom surface of the forefoot support, wherein the first groove is configured to provide flexibility to the forefoot support in a first direction; and a second groove traversing the forefoot support along a second axis, the second groove being located on the bottom surface of the forefoot support, wherein the second groove is configured to provide flexibility to the forefoot support in a second direction, wherein the bottom surface of the forefoot support is configured to face toward the outsole. In some embodiments, the footwear article further comprises a midsole and/or a body.

The footwear article may comprise a shoe, boot, sandal, skate, slipper, or any combination of these. Shoes or boots may be specialized for sports such as cycling, running, skiing, walking, climbing, American football, soccer, dance, volleyball, basketball, or other sports played on a field or on a court. The forefoot support as described herein may be made to fit any of these types of sport shoes or boots, or subtypes of shoes or boots. For example, within the category of cycling shoes, there are road bike shoes, mountain bike shoes, indoor cycling shoes, and cycling sandals. An example forefoot support may be shaped to fit into a cycling shoe in one of these categories. Cycling shoes are typically designed to be aerodynamic, curved, and lightweight. Forefoot support in such shoes should be flexible so they fit the contours of the curved shoes, ventilated for the user's comfort and performance, and thin.

Custom Forefoot Support

While the forefoot support described herein may be a part of a standard insole that is configured to fit any of a number of users (one size fits all) or shoes, custom forefoot support offers a better fit for the user and the ability to customize the forefoot to the type of shoe. Custom forefoot support may also be used to correct pathological conditions in the user, or to correct or improve the static and dynamic pressures on the foot. Custom forefoot support may also be used to prevent injuries or forestall the onset of foot conditions, such as stress-related injuries to the foot, ankle, leg, knee, hip, or back. For athletes, custom forefoot support may be used to improve biomechanical performance, for example, by altering the angle of impact of a user's foot during dynamic activities such as running and thereby increasing the overall speed of the running. Similarly, if the forefoot support provides optimal alignment of a user's feet, knees, and hips during activities such as cycling, then the power, endurance, and comfort of the cyclist should be improved.

Methods for customization are described in PCT/EP2015/060162, the contents of which are incorporated herein in their entirety.

Custom forefoot supports may be designed using data regarding a particular user's physical characteristics or attributes-so called "static" user data. For example, a user's foot size and static foot pressure (e.g. when standing) may be measured.

Custom forefoot supports may also be designed using dynamic user data, such as dynamic foot pressure measurements. For example, the dynamic pressures on a user's foot may be measured during dynamic foot activities, such as: running, walking, jumping, landing, pivoting, rolling, rocking, etc. Virtually any functional biomechanical measurements may be used during the design of custom footwear.

Custom forefoot supports may also be designed using non-user-specific data, such as a statistical population data. For example, the average shape of a foot of a certain size may be statistically determined, or otherwise available from existing statistical datasets. Further, the statistical averages for these and other physical foot characteristics may have associated statistical parameters, such as distributions, standard deviations, variances, and others as are known in the art. In this way, knowing a single foot characteristic associated with a user, such as a shoe size, may enable the use of many associated statistical foot characteristics (e.g. shape, size, etc.).

As the arrangement of grooves in the forefoot support confer flexibility, the grooves may be tailored to the users need for flexibility.

Additive Manufacturing

Forefoot supports or insoles according to the embodiments described herein, can be manufactured using additive manufacturing techniques. Many methods of additive manufacturing are known in the art, such as: Stereolithography (SLA), Selective Laser Sintering (SLS), Selective Laser Melting (SLM) and Fused Deposition Modeling (FDM), among others.

Stereolithography (SLA) is an additive manufacturing technique used for "printing" 3D objects one layer at a time. An SLA apparatus may employ, for example, a laser to cure a photo-reactive substance with emitted radiation. In some embodiments, the SLA apparatus directs the laser across a surface of a photo-reactive substance, such as, for example, a curable photopolymer ("resin"), in order to build an object one layer at a time. For each layer, the laser beam traces a cross-section of the object on the surface of the liquid resin, which cures and solidifies the cross-section and joins it to the layer below. After a layer has been completed, the SLA apparatus lowers a manufacturing platform by a distance equal to the thickness of a single layer and then deposits a new surface of uncured resin (or like photo-reactive material) on the previous layer. On this surface, a new pattern is traced thereby forming a new layer. By repeating this process one layer at a time, a complete 3D part may be formed.

Selective laser sintering (SLS) is another additive manufacturing technique used for 3D printing objects. SLS apparatuses often use a high-powered laser (e.g. a carbon dioxide laser) to "sinter" (i.e. fuse) small particles of plastic, metal, ceramic, or glass powders into a 3D object. Similar to SLA, the SLS apparatus may use a laser to scan cross-sections on the surface of a powder bed in accordance with a CAD design. Also similar to SLA, the SLS apparatus may lower a manufacturing platform by one layer thickness after a layer has been completed and add a new layer of material in order that a new layer can be formed. In some embodiments, an SLS apparatus may preheat the powder in order to make it easier for the laser to raise the temperature during the sintering process.

Selective Laser Melting (SLM) is yet another additive manufacturing technique used for 3D printing objects. Like SLS, an SLM apparatus typically uses a high-powered laser to selectively melt thin layers of metal powder to form solid metal objects. While similar, SLM differs from SLS because it typically uses materials with much higher melting points. When constructing objects using SLM, thin layers of metal powder may be distributed using various coating mechanisms. Like SLA and SLS, a manufacturing surface moves up and down to allow layers to be formed individually.

Fused Deposition Modeling (FDM) is another additive manufacturing technique wherein a 3D object is produced by extruding small beads of, for example, thermoplastic material from an extrusion nozzle to form layers. In a typical arrangement, the extrusion nozzle is heated to melt the raw material as it is extruded. The raw material then hardens immediately after extrusion from a nozzle. The extrusion nozzle can be moved in one or more dimensions by way of appropriate machinery. Similar to the aforementioned additive manufacturing techniques, the extrusion nozzle follows a path controlled by CAD or CAM software. Also similar, the part is built from the bottom up, one layer at a time.

Objects may be formed by additive manufacturing apparatus using various materials, such as: polypropylene, thermoplastic polyurethane, polyurethane, acrylonitrile butadiene styrene (ABS), polycarbonate (PC), PC-ABS, PLA, polystyrene, lignin, polyamide, polyamide with additives such as glass or metal particles, methyl methacrylate-acrylonitrilebutadiene-styrene copolymer, resorbable materials such as polymer-ceramic composites, and other similar suitable materials. In some embodiments, commercially available materials may be utilized. These materials may include: DSM Somos® series of materials 7100, 8100, 9100, 9420, 10100, 11100, 12110, 14120 and 15100 from DSM Somos; ABSplus-P430, ABSi, ABS-ESD7, ABS-M30, ABS-M30i, PC-ABS, PC-ISO, PC, ULTEM 9085, PPSF and PPSU materials from Stratasys; Accura Plastic, DuraForm, CastForm, Laserform and VisiJet line of materials from 3D Systems; Aluminium, CobaltChrome and Stainless Steel materials; Maranging Steel; Nickel Alloy; Titanium; the PA line of materials, PrimeCast and PrimePart materials and Alumide and CarbonMide from EOS GmbH.

Custom forefoot supports or insoles according to the embodiments herein may be manufactured using additive manufacturing techniques. Advantageously, an additive manufacturing apparatus may "3D print" an entire insole, portions of an insole, or an entire piece of footwear comprising the forefoot support in a single, integral workpiece. For example, rather than manufacturing components of insoles, midsoles and/or outsoles separately, an additive manufacturing device may create a custom insole layer-by-layer with non-homogeneous corrective features (e.g. microstructures) in each individual layer. Thus, 3D printing may provide a much higher degree of customization of insoles and footwear as compared to traditional manufacturing techniques.

Further, 3D printing custom insoles may advantageously reduce the number of materials and individual pieces that need to be manufactured in order to arrive at a desired footwear design. Moreover, additive manufacturing techniques may take advantage of a wider range of materials for creating custom insoles as compared to traditional manufacturing techniques.

In some instances, additive manufacturing techniques may improve traditional manufacturing steps. For example, insoles or portions of insoles may include surface textures, patterns, structures, etc., which may be useful for traditional manufacturing steps such as gluing, fusing, or otherwise fastening portions together. In some instances, the surface textures may be created by microstructures. As another example, an additively manufactured insole may be finished with a manufacturing layer that has a high porosity and/or a particular texture in order to improve the joining of that portion with another footwear portion by glue or other fastening means.

Figure 1:
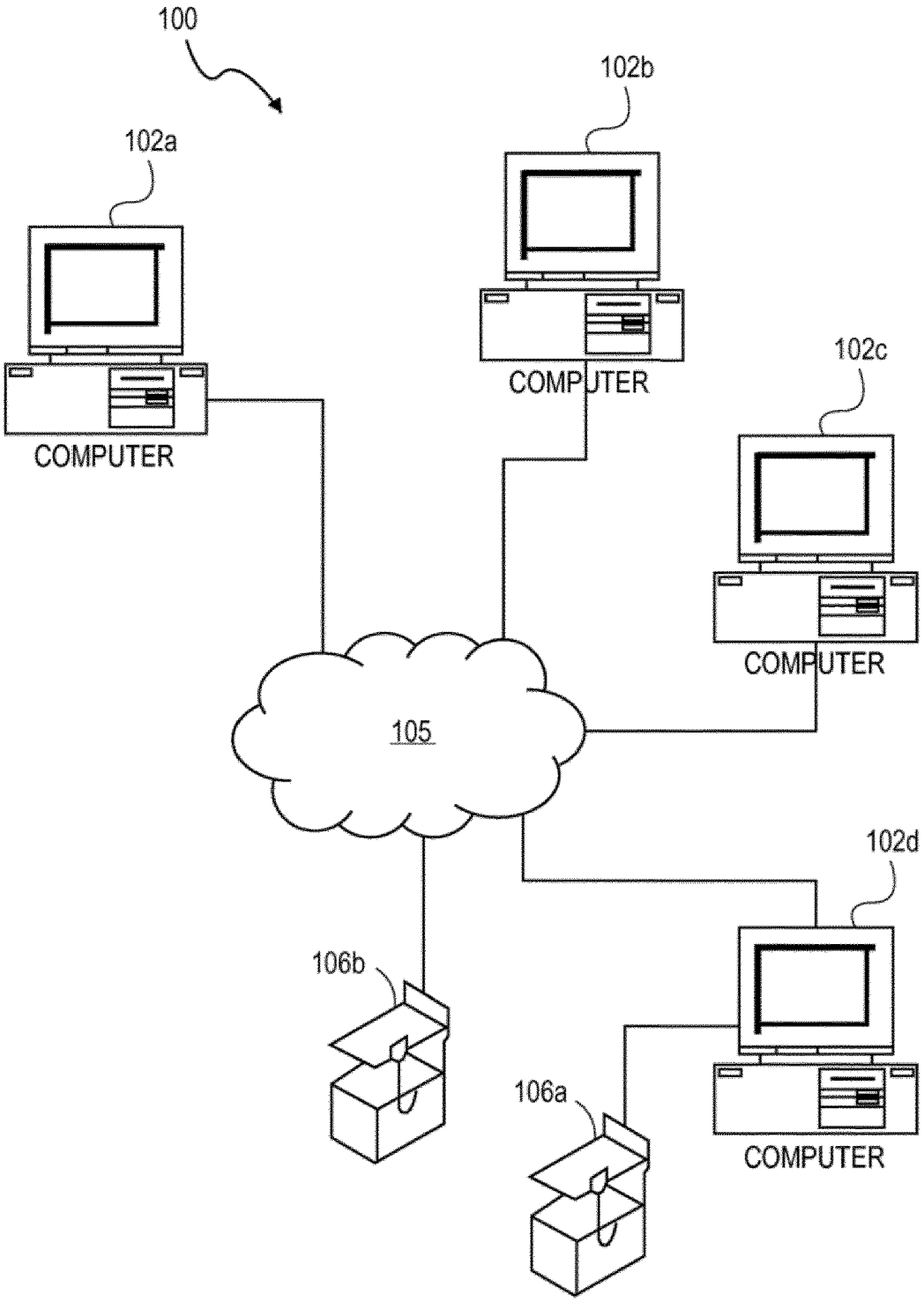
FIG. 1 illustrates an example of a computer environment suitable for the implementation of 3D object design and manufacturing.

Embodiments of the present disclosure may be practiced within a system for designing and manufacturing 3D objects. Turning to FIG. 1, an example of a computer environment suitable for the implementation of 3D object design and manufacturing is shown. The environment includes a system 100. The system 100 includes one or more computers 102*a*-102*d*, which can be, for example, any workstation, server, or other computing device capable of processing information. In some aspects, each of the computers 102*a*-102*d* can be connected, by any suitable communications technology (e.g., an internet protocol), to a network 105 (e.g., the Internet). Accordingly, the computers 102*a*-102*d* may transmit and receive information (e.g., software, digital representations of 3-D objects, commands or instructions to operate an additive manufacturing device, etc.) between each other via the network 105.

The system 100 further includes one or more additive manufacturing devices or apparatuses (e.g., 3-D printers) 106*a*-106*b*. As shown the additive manufacturing device 106*a* is directly connected to a computer 102*d* (and through computer 102*d* connected to computers 102*a*-102*c* via the network 105) and additive manufacturing device 106*b* is connected to the computers 102*a*-102*d* via the network 105. Accordingly, one of skill in the art will understand that an additive manufacturing device 106 may be directly connected to a computer 102, connected to a computer 102 via a network 105, and/or connected to a computer 102 via another computer 102 and the network 105.

It should be noted that though the system 100 is described with respect to a network and one or more computers, the techniques described herein also apply to a single computer 102, which may be directly connected to an additive manufacturing device 106.

Figure 2:
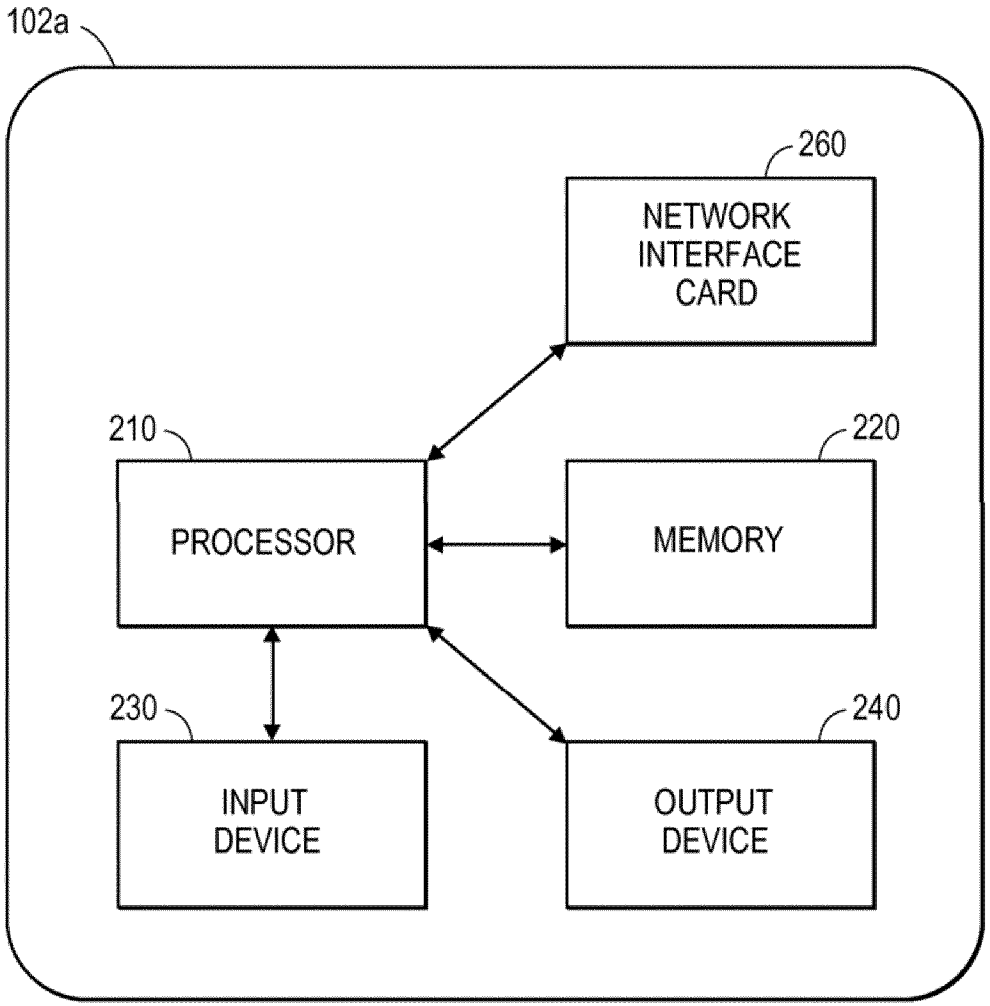
FIG. 2 illustrates an example functional block diagram of one example of a computer.

FIG. 2 illustrates a functional block diagram of one example of a computer of FIG. 1. The computer 102*a* includes a processor 210 in data communication with a memory 220, an input device 230, and an output device 240. In some embodiments, the processor is further in data communication with an optional network interface card 260. Although described separately, it is to be appreciated that functional blocks described with respect to the computer 102*a* need not be separate structural elements. For example, the processor 210 and memory 220 may be embodied in a single chip.

The processor 210 can be a general purpose processor, a digital signal processor (DSP), an application specific integrated circuit (ASIC), a field programmable gate array (FPGA) or other programmable logic device, discrete gate or transistor logic, discrete hardware components, or any suitable combination thereof designed to perform the functions described herein. A processor may also be implemented as a combination of computing devices, e.g., a combination of a DSP and a microprocessor, a plurality of microprocessors, one or more microprocessors in conjunction with a DSP core, or any other such configuration.

The processor 210 can be coupled, via one or more buses, to read information from or write information to memory 220. The processor may additionally, or in the alternative, contain memory, such as processor registers. The memory 220 can include processor cache, including a multi-level hierarchical cache in which different levels have different capacities and access speeds. The memory 220 can also include random access memory (RAM), other volatile storage devices, or non-volatile storage devices. The storage can include hard drives, optical discs, such as compact discs (CDs) or digital video discs (DVDs), flash memory, floppy discs, magnetic tape, and Zip drives.

The processor 210 also may be coupled to an input device 230 and an output device 240 for, respectively, receiving input from and providing output to a user of the computer 102*a*.

Suitable input devices include, but are not limited to, a keyboard, buttons, keys, switches, a pointing device, a mouse, a joystick, a remote control, an infrared detector, a bar code reader, a scanner, a video camera (possibly coupled with video processing software to, e.g., detect hand gestures or facial gestures), a motion detector, or a microphone (possibly coupled to audio processing software to, e.g., detect voice commands). Suitable output devices include, but are not limited to, visual output devices, including displays and printers, audio output devices, including speakers, headphones, earphones, and alarms, additive manufacturing devices, and haptic output devices.

The processor 210 further may be coupled to a network interface card 260. The network interface card 260 prepares data generated by the processor 210 for transmission via a network according to one or more data transmission protocols. The network interface card 260 also decodes data received via a network according to one or more data transmission protocols. The network interface card 260 can include a transmitter, receiver, or both. In other embodiments, the transmitter and receiver can be two separate components. The network interface card 260, can be embodied as a general purpose processor, a digital signal processor (DSP), an application specific integrated circuit (ASIC), a field programmable gate array (FPGA) or other programmable logic device, discrete gate or transistor logic, discrete hardware components, or any suitable combination thereof designed to perform the functions described herein.

Figure 3:
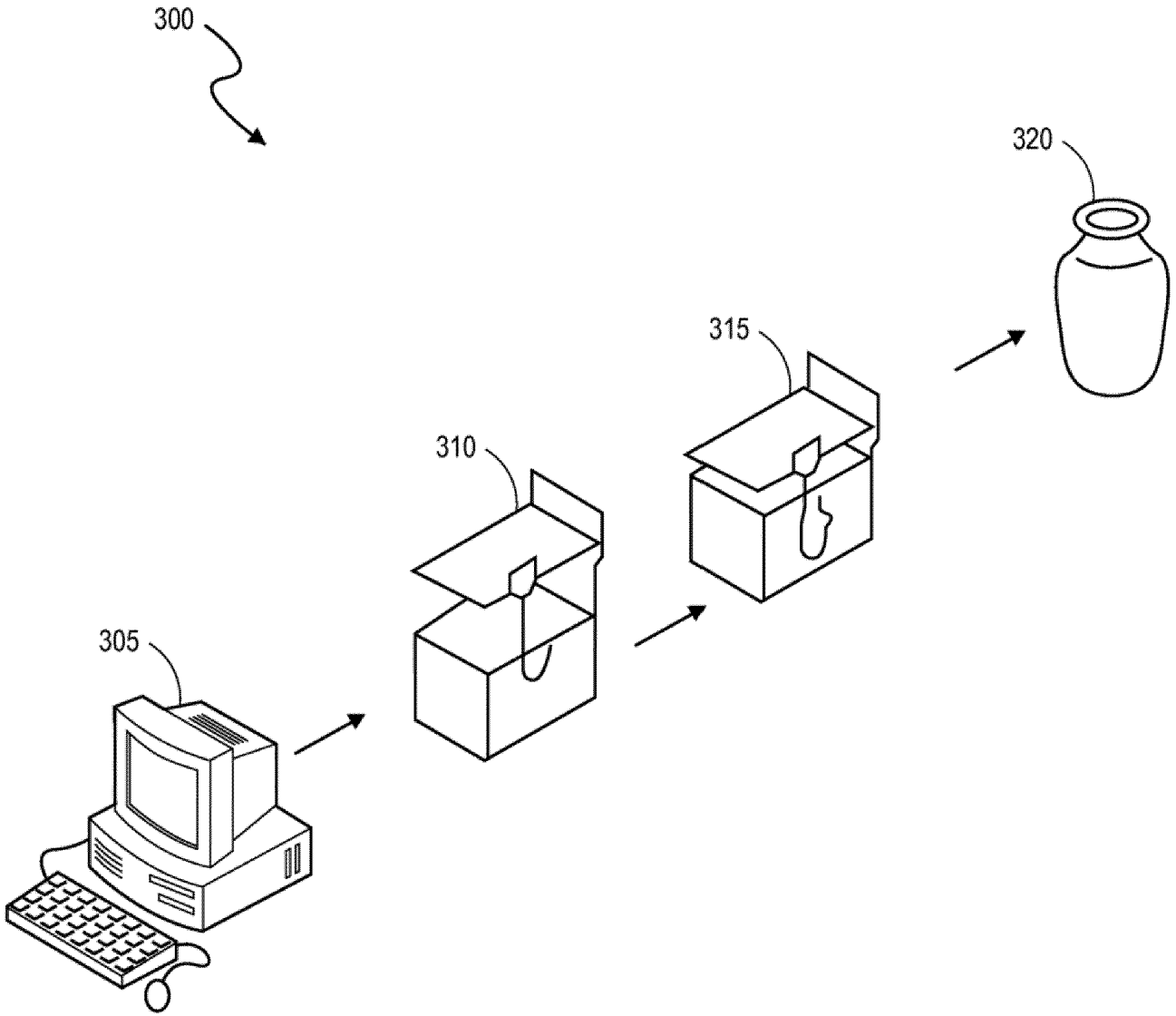
FIG. 3 shows an example high level process for manufacturing a 3D object using the methods and systems disclosed herein.

FIG. 3 illustrates a process 300 for manufacturing a 3-D object or device. As shown, at a step 305, a digital representation of the object is designed using a computer, such as the computer 102*a*. For example, 2-D or 3-D data may be input to the computer 102*a* for aiding in designing the digital representation of the 3-D object. Continuing at a step 310, information is sent from the computer 102*a* to an additive manufacturing device, such as additive manufacturing device 106, and the device 106 commences the manufacturing process in accordance with the received information. At a step 315, the additive manufacturing device 106 continues manufacturing the 3-D object using suitable materials, such as a liquid resin.

These suitable materials may include, but are not limited to a photopolymer resin, polyurethane, methyl methacrylate-acrylonitrile-butadiene-styrene copolymer, resorbable materials such as polymer-ceramic composites, etc.

Figure 4:
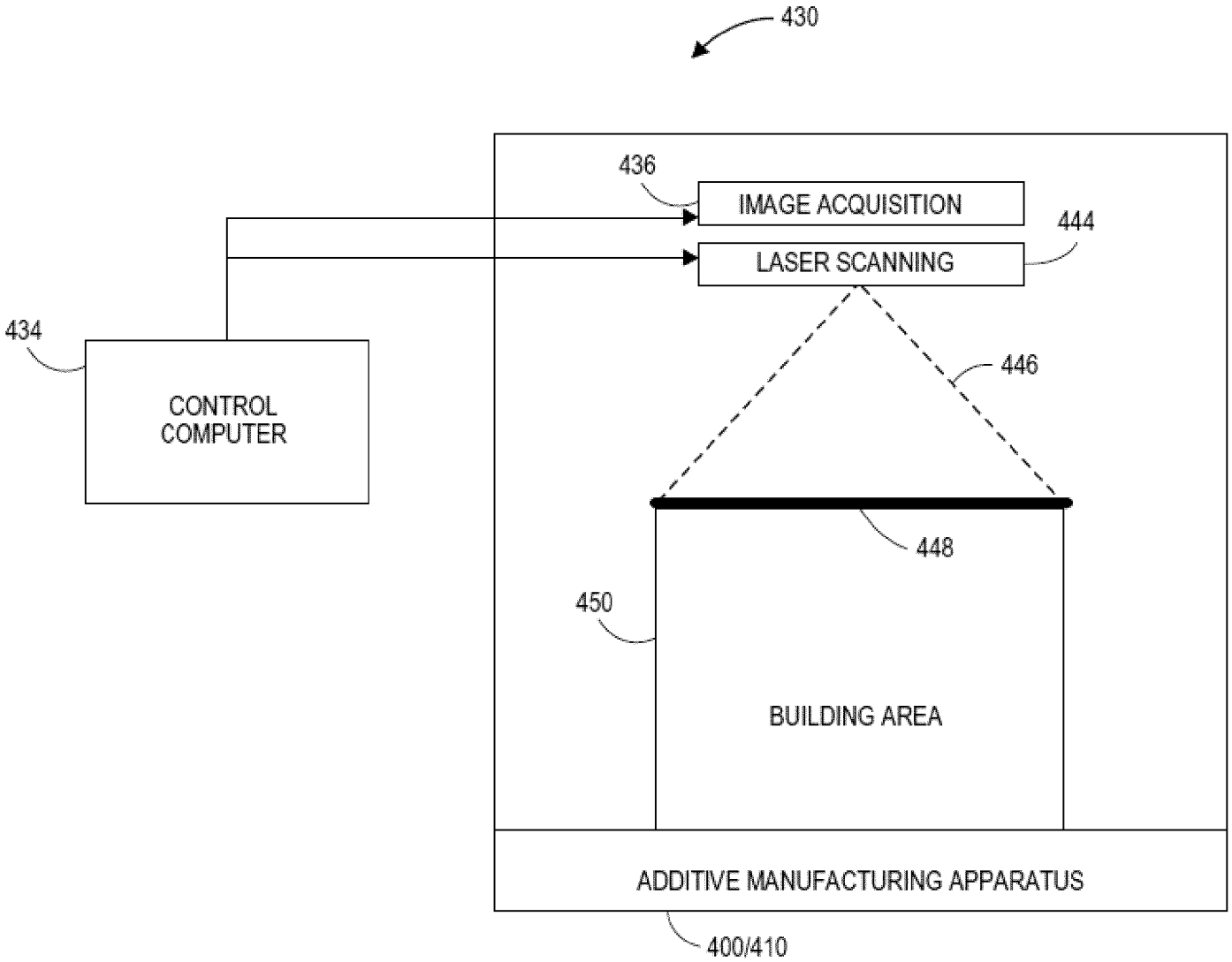
FIG. 4 is an example of a scanning system which may be calibrated using the methods and systems disclosed herein.

FIG. 4 illustrates an example additive manufacturing apparatus 400 for generating a three-dimensional (3-D) object. In this example, the additive manufacturing apparatus 400 is a laser sintering device. The laser sintering device 400 may be used to generate one or more 3D objects layer by layer. The laser sintering device 400, for example, may utilize a powder (e.g., metal, polymer, etc.), to build an object a layer at a time as part of a build process.

Successive powder layers are spread on top of each other using, for example, a recoating mechanism (e.g., a recoater blade, drum, or roller). The recoating mechanism deposits powder for a layer as it moves across the build area, for example in the direction shown, or in the opposite direction if the recoating mechanism is starting from the other side of the build area, such as for another layer of the build. After deposition, a computer-controlled CO2 laser beam scans the surface and selectively binds together the powder particles of the corresponding cross section of the product. In some embodiments, the laser scanning device is an X-Y moveable infrared laser source. As such, the laser source can be moved along an X axis and along a Y axis in order to direct its beam to a specific location of the top most layer of powder. Alternatively, in some embodiments, the laser scanning device may comprise a laser scanner which receives a laser beam from a stationary laser source, and deflects it over moveable mirrors to direct the beam to a specified location in the working area of the device. During laser exposure, the powder temperature rises above the material (e.g., glass, polymer, metal) transition point after which adjacent particles flow together to create the 3D object. The device 400 may also optionally include a radiation heater (e.g., an infrared lamp) and/or atmosphere control device. The radiation heater may be used to preheat the powder between the recoating of a new powder layer and the scanning of that layer. In some embodiments, the radiation heater may be omitted. The atmosphere control device may be used throughout the process to avoid undesired scenarios such as, for example, powder oxidation.

The control computer 434 may be configured to control operations of the additive manufacturing apparatus 400. In some embodiments, the control computer may be one or more computers 102 from FIG. 2 or the computer 305 from FIG. 3. In some embodiments, the control computer 434 may be a controller built into or configured to interface with the additive manufacturing apparatus 400.

Various embodiments disclosed herein provide for the use of a computer control system. A skilled artisan will readily appreciate that these embodiments may be implemented using numerous different types of computing devices, including both general purpose and/or special purpose computing system environments or configurations.

Examples of well-known computing systems, environments, and/or configurations that may be suitable for use in connection with the embodiments set forth above may include, but are not limited to, personal computers, server computers, hand-held or laptop devices, multiprocessor systems, microprocessor-based systems, programmable consumer electronics, network PCs, minicomputers, mainframe computers, distributed computing environments that include any of the above systems or devices, and the like. These devices may include stored instructions, which, when executed by a microprocessor in the computing device, cause the computer device to perform specified actions to carry out the instructions. As used herein, instructions refer to computer-implemented steps for processing information in the system. Instructions can be implemented in software, firmware or hardware and include any type of programmed step undertaken by components of the system.

A microprocessor may be any conventional general purpose single- or multi-chip microprocessor such as a Pentium® processor, a Pentium® Pro processor, a 8051 processor, a MIPS® processor, a Power PC® processor, or an Alpha® processor. In addition, the microprocessor may be any conventional special purpose microprocessor such as a digital signal processor or a graphics processor. The microprocessor typically has conventional address lines, conventional data lines, and one or more conventional control lines.

Aspects and embodiments of the present disclosure disclosed herein may be implemented as a method, apparatus or article of manufacture using standard programming or engineering techniques to produce software, firmware, hardware, or any combination thereof. The term "article of manufacture" as used herein refers to code or logic implemented in hardware or nontransitory computer readable media such as optical storage devices, and volatile or non-volatile memory devices or transitory computer readable media such as signals, carrier waves, etc. Such hardware may include, but is not limited to, field programmable gate arrays (FPGAs), application-specific integrated circuits (ASICs), complex programmable logic devices (CPLDs), programmable logic arrays (PLAs), microprocessors, or other similar processing devices.

The control computer 434 may be connected to a laser scanning device 444. The laser scanning device may include movable mirrors which can direct the laser beam received from a laser source into the building area. The laser source may also be a movable laser source, or it may also be the laser scanner provided in a stereolithography device 400. The control computer 434 may further include software which controls the movement and functionality of the laser scanning system 444. As such, the control computer 434 may be configured to control the moment and activation of the laser scanning device.

The control computer 434 may further be configured to interface with an image acquisition assembly 436, such as to receive data/images from the image acquisition assembly 436. The control computer 434 may further be configured to process the data/images to determine if errors have or will occur in the build process as described herein. The control computer 434 may further be configured to control when and how the image acquisition assembly 436 captures images.

The image acquisition assembly 436 may be configured to attach to, be integrated with, and/or sit separate from the additive manufacturing apparatus 400 and placed in such a position to monitor the building area 450 and/or the build surface. Further, the image acquisition assembly 436 may be configured to be stationary, or moveable (such as based on control signals received from the control computer 434) to monitor the building area 450 from different angles.

The image acquisition assembly 436 may be configured to acquire images of a calibration plate 448 or a build surface. More particularly, the image acquisition assembly 436 may be configured to acquire images of laser spots and/or other markings made on the calibration plate 448 or build surface by the scanning system 444.

The image acquisition assembly 436 may include a camera, for example, an optical camera. The camera may be a commercial off-the-shelf ("COTS") digital camera having sufficient resolution to capture spots and other markings on the calibration plate 448 or build surface in sufficient detail to calibrate the scanning device. In some embodiments, the image acquisition assembly is selected from an optical camera, a thermal imaging device, an IR camera, or a sensor that transfers other signals to visual signals.

A camera may take the form of a special purpose camera which is configured to capture spots reflecting from the surface of the calibration plate. In order to capture spots on the calibration plate, it may be necessary to position the camera so that it points to the area near the spot created by a scanner in the scanning system 444. Accordingly, the image acquisition assembly 436 may also include a mount. In some embodiments, the mount may be a tilt-pan mount, which provides a range of motion sufficient to capture images in various locations on the calibration plate 448. The mount may be driven by a motor. The motor may be configured to receive control signals from the control computer 434 which provide instructions for the movement of the camera 450. In some embodiments, in addition to having a tilt-pan range of motion, the camera 450 may be further mounted on a projecting arm of a crane, commonly referred to as a jib. The jib may provide a further range of motion by allowing the camera not only to tilt and pan, but also to physically move its location in order to better acquire images of spots and/or markings on the calibration plate 448 or build surface.

The preceding specification has been described with reference to specific embodiments thereof. Various modifications and changes may be made thereto without departing from the broader scope of embodiments. The specifications and drawings are, accordingly, to be regarded in an illustrative sense rather than a restrictive sense.

The invention claimed is:

1. A footwear insole, comprising: a forefoot support comprising: a plurality of openings; a rim configured to form a border around least a portion of the forefoot support; a first set of evenly spaced, straight grooves traversing the forefoot support parallel to a first axis, the first axis extending from a toe end of the insole to a heel end of the insole, wherein the first set of grooves is configured to provide flexibility to the forefoot support in a first direction; and a second set of evenly spaced, straight grooves traversing the forefoot support parallel to a second axis, the second axis extending from a medial side of the insole to a lateral side of the insole, wherein the second set of grooves is configured to provide flexibility to the forefoot support in a second direction, wherein each of the plurality of openings is formed within a corresponding one of the first set of grooves, wherein each of a first set of the plurality of openings is at least partially formed within a corresponding one of the second set of grooves, wherein each of a second set of the plurality of openings is not formed within any of the second set of grooves, and wherein the plurality of openings are regularly spaced apart, and openings in adjacent grooves of the first set of grooves are staggered with respect to one another; and an additional support extending from a hindfoot area of the footwear insole to a midfoot area of the footwear insole, wherein the additional support comprises a distinct structure from the forefoot support such that the entire area of the footwear insole extending from the hindfoot area of the footwear insole to the midfoot area of the insole does not include openings or grooves, wherein the footwear insole is a one-piece structure.

2. The footwear insole of claim 1, wherein the plurality of openings are arrayed in one line or in multiple lines.

3. The footwear insole of claim 1, wherein the plurality of openings are arrayed in rows.

4. The footwear insole of claim 1, wherein the first set of grooves and the second set of grooves are located in a bottom surface of the forefoot support.

5. The footwear insole of claim 4, wherein the bottom surface of the forefoot support is configured to contact a surface on a footwear article and not contact a surface of a user's foot.

6. The footwear insole of claim 4, wherein the first set of grooves and the second set of grooves intersect to form recessed structures that are separated by raised structures.

7. The footwear insole of claim 6, wherein the first set of grooves and the second set of grooves are configured to provide greater flexibility when the raised structures are bent towards one another than when the raised structures are bent away from one another.

8. The footwear insole of claim 6, wherein the raised structures are rectangular in shape.

9. The footwear insole of claim 1, wherein each of the first set of grooves traverses an entire line between two points on the rim of the forefoot support.

10. The footwear insole of claim 1, wherein the rim comprises one or more notches that extend from a top surface to a bottom surface of the forefoot support thereby creating one or more openings in the forefoot support.

11. The footwear insole of claim 10, wherein the one or more notches are positioned to correspond to joints in a user's forefoot.

12. A footwear article, comprising: an outsole; and an insole comprising: a forefoot support comprising: a plurality of openings; a rim configured to form a border around least a portion of the forefoot support; a first set of evenly spaced, straight grooves traversing the forefoot support parallel to a first axis, the first axis extending from a toe end of the insole to a heel end of the insole, the first set of grooves being located on a bottom surface of the forefoot support, wherein the first set of grooves is configured to provide flexibility to the forefoot support in a first direction; and a second set of evenly spaced, straight grooves traversing the forefoot support parallel to a second axis, the second axis extending from a medial side of the insole to a lateral side of the insole, the second groove being located on the bottom surface of the forefoot support, wherein the second set of grooves is configured to provide flexibility to the forefoot support in a second direction, wherein each of the plurality of openings is formed within a corresponding one of the first set of grooves, wherein each of a first set of the plurality of openings is at least partially formed within a corresponding one of the second set of grooves, wherein each of a second set of the plurality of openings is not formed within any of the second set of grooves, and wherein the plurality of openings are regularly spaced apart, and openings in adjacent grooves of the first set of grooves are staggered with respect to one another, wherein the bottom surface of the forefoot support is configured to face toward the outsole; and an additional support extending from a hindfoot area of the footwear insole to a midfoot area of the footwear insole, wherein the additional support comprises a distinct structure from the forefoot support such that the entire area of the footwear insole extending from the hindfoot area of the footwear insole to the midfoot area of the insole does not include openings or grooves, wherein the insole is a one-piece structure.

13. The footwear insole of claim 1, wherein an entire boundary of each of the plurality of openings is completely in a corresponding groove traversing the forefoot support.

* * * * *